US005192186A

United States Patent [19]

Sadler

[11] Patent Number: 5,192,186

[45] Date of Patent: Mar. 9, 1993

[54] GAS TURBINE ENGINE

[75] Inventor: John H. R. Sadler, Derby, United Kingdom

[73] Assignee: Rolls-Royce plc, London, England

[21] Appl. No.: 699,446

[22] Filed: Nov. 20, 1984

Related U.S. Application Data

[63] Continuation of Ser. No. 295,320, Jul. 31, 1981, abandoned.

[30] Foreign Application Priority Data

Oct. 3, 1980 [GB] United Kingdom ..... 8031989

[51] Int. Cl.[5] ..... F01D 25/08

[52] U.S. Cl. ..... 415/177

[58] Field of Search ..... 60/39.83, 266; 415/114, 415/115, 117; 416/96 R; 165/104.22, 104.26

[56] References Cited

U.S. PATENT DOCUMENTS 3,675,711 7/1972 Bilinski et al. ..... 165/104.26
4,127,357 11/1978 Patterson ..... 415/177
4,199,300 4/1980 Tubbs ..... 415/114
4,207,027 6/1980 Barry ..... 416/96 R
4,218,178 8/1980 Irwin ..... 415/114
4,337,016 6/1982 Chaplin ..... 415/177

OTHER PUBLICATIONS

*Composite Ceramic-Metal Systems;* Levy et al Astronautics; Apr. 1961.

*Primary Examiner*—Michael J. Carone
*Attorney, Agent, or Firm*—Cushman, Darby & Cushman

[57] ABSTRACT

A shroud ring suitable for the turbine of a gas turbine engine comprises an annular heat pipe with radially inwardly directed flanges which are bridged by a plurality of abutting tiles so that together they define an annular chamber. The annular chamber serves to provide a thermal barrier between the tiles and a major portion of the heat pipe. The operating temperature of the shroud ring is thus reduced thereby ensuring reduced radial expansion.

8 Claims, 2 Drawing Sheets

Fig. 1.
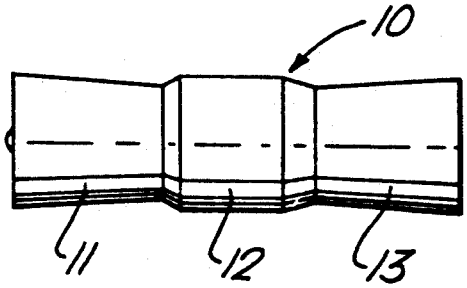
Fig. 3.
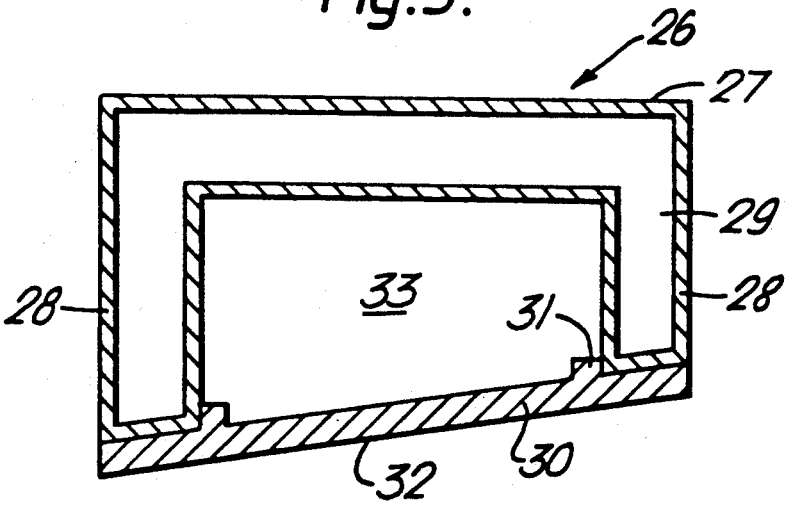
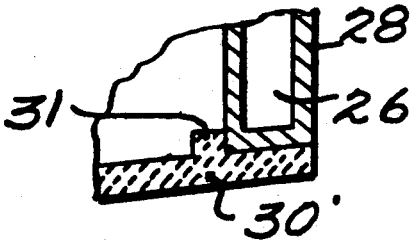
Fig. 3A.

GAS TURBINE ENGINE

This is a continuation, of application Ser. No. 295,320, filed Jul. 31, 1981 now abandoned.

This invention relates to gas turbine engines and in particular to the turbines of such engines.

In the pursuit of better gas turbine engine specific fuel consumption, higher bypass ratios have been utilized which have in turn led to increased power from the gas generator. However, this increased gas generator power has resulted in higher turbine entry temperatures. While such increased temperatures are desirable from the point of view of engine efficiency, it has proved to be increasingly difficult to provide turbine components which will withstand such temperatures over long periods of time without suffering some kind of structural failure. In particular, severe problems have been encountered with turbine components which are subjected in use to localized thermal gradients. This results in thermal stress being involved in those components which can in turn cause their distortion or cracking.

Thermal gradients are a particular problem in the case of turbine shroud rings. Shroud rings are commonly used in axial flow turbines to define a portion of the gas passage through the turbine and surround an annular array of rotary aerofoil blades. It is common for shroud rings to vary in temperature by as much as 300° C. in an axial direction. This often results in the distortion of the shroud ring, thereby causing sealing problems with the array of rotary aerofoil blades with which it cooperates.

It has been suggested to manufacture shroud rings in the form of heat pipes so that in operation they are substantially isothermal. This eliminates distortion due to thermal gradients but results in a high overall operating temperature for the shroud ring. Consequently during turbine operation cycles the shroud ring tends to radially expand and contract by amounts which have a detrimental effect on the clearances between the shroud ring and the tips of the rotary aerofoil blades. Thus, while the clearances between the shroud ring and blade tips should ideally be as small as possible, high shroud ring temperatures ensure that such small clearances cannot be maintained.

It is an object of the present invention to provide a shroud ring which includes a heat pipe and which is subject to reduced radial expansion.

According to the present invention, a shroud ring suitable for the turbine of a gas turbine engine comprises, in combination, means adapted to define an annular, radially inwardly facing surface, an annular heat pipe positioned radially outwardly of said surface defining means and spacing means adapted to radially space apart at least a major portion of said heat pipe and said surface defining means in such a manner that an annular thermal barrier is provided by them.

Said thermal barrier is preferably in the form of an annular chamber which is defined by said heat pipe, said surface defining means and said spacing means and contains a thermal insulator.

Said thermal insulator may be air.

Said annular chamber may be provided with an inlet and an outlet whereby an air flow may be maintained through said annular chamber.

Said spacing means preferably comprises radially extending flanges which constitute portions of said heat pipe.

Said annular heat pipe is preferably of generally U-shaped cross section to provide two radially extending flanges which constitute said spacing means, said surface defining means bridging said flanges to define said annular chamber.

Said surface defining means preferably comprises a plurality of abutting tiles which together define said annular radially inwardly facing surface.

Said tiles may be either metallic or ceramic.

The invention will now be described by way of example with reference to the accompanying drawings in which:

FIG. 1 is a side view of a gas turbine engine incorporating a shroud ring in accordance with the present invention, FIG. 3 is an enlarged view of a portion of the turbine shown in FIG. 2.

FIG. 3A is a fragmentary section of a view similar to FIG. 3 but showing the tiles made of a ceramic material.

Figure 2:
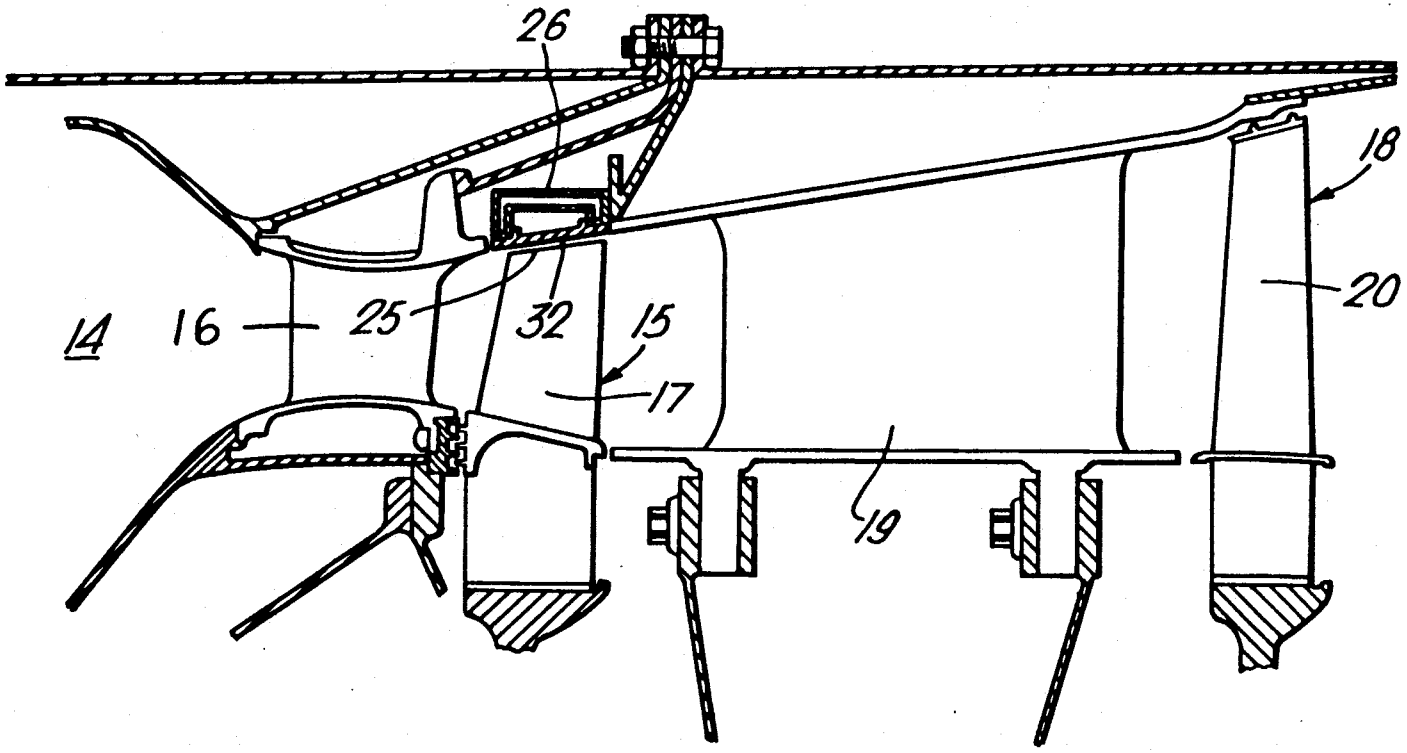
FIG. 2 is a sectioned side view of a portion of the turbine of the gas turbine engine shown in FIG. 1.

With reference to FIG. 1, a gas turbine engine generally indicated at 10 consists of a compressor 11, combustion equipment 12 and a turbine 13. The gas turbine engine 10 operates in the conventional manner, that is, air compressed by the compressor 11 is mixed with fuel and combusted in the combustion equipment 12. The resultant hot gases expand through the turbine 13 to atmosphere, thereby driving the turbine 13 which in turn drives the compressor 11.

The combustion equipment 12 comprises an annular combustion chamber 14, a portion of the downstream end of which can be seen in FIG. 2. Hot gases from the combustion chamber 14 are directed into the high pressure section 15 of the turbine 13 by an annular array of stationary nozzle guide vanes, one of which can be seen at 16. In this particular case, the high pressure turbine 15 consists of a single stage of rotatably mounted turbine blades one of which can be seen at 17. The high pressure turbine 15 is drivingly connected by a suitable shaft (not shown) to the high pressure portion of the compressor 11.

The hot gases issued from the high pressure turbine 15 are then directed into the low pressure turbine 18 by a second annular array of stationary nozzle guide vanes, one of which can be seen at 19. As in the case of the high pressure turbine 15, the low pressure turbine 18 consists of a single stage of rotatably mounted turbine blades, one of which can be seen at 20. The low pressure turbine is drivingly connected by a further suitable shaft (not shown) to the low pressure portion of the compressor 11. The hot gases issued from the low pressure turbine 18 then pass through an annular array of outlet guide vanes (not shown) before being exhausted to atmosphere.

In order to ensure that as much as possible of the hot gases directed by the high pressure nozzle guide vanes 16 pass over the aerofoil portions of the high pressure turbine blades 17, the tips 25 of the turbine blades 17 are arranged to pass as closely as possible to an annular shroud ring 26.

The shroud ring 26 can be seen more clearly in FIG. 3. It comprises an annular heat pipe 27 which is of generally U-shaped cross-section so as to provide two radially inwardly extending flanges 28.

Throughout this specification the term "heat pipe" is to be understood as meaning a heat transfer device comprising a sealed container which encloses both a condensable vapour and capillary means capable of causing the transport of the condensed vapor from a cooler area of the container to a hotter area, the condensable vapor being transported from the hotter area to the cooler area by the vapor pressure gradient between the two areas, the vapor being condensed in the cooler area.

The variation of vapor pressure with temperature of such substances as water, ammonia, mercury, caesium, potassium, sodium, lithum and lead is such that a change in temperature of only 1° or 2° C. gives a very large change in their vapor pressure. Consequently the temperature differences occurring over the length of a heat pipe containing one of these substances as the condensable vapor are so small as to render the heat pipe substantially isothermal. In practice, the effective thermal conductivity of a heat pipe can be as much as 500 times greater than that of a solid copper rod having the same mass. The principles behind heat pipes are more thoroughly set out in "Structures of Very High Thermal Conductance", Graver, Cotter and Erickson, Journal of Applied Physics Vol 35, 1990 (June 1964).

The internal wall of the heat pipe 27 is covered with a stainless steel mesh 29 which functions as a wickor capillary for the heat pipe. It will be appreciated, however, that other alternative capillary materials such as porous glass, metal or ceramic could be utilized.

In order to enable the heat pipe 27 to function, it is evacuated and contains a small amount of sodium as the condensable vapor. Other materials could, however, be utilized as the condensable vapor as will be apparent from the above description.

The radially inwardly extending flanges 28 of the heat pipe 27 are bridged by a series of similar abutting tiles 30. Location ribs 31 on the tiles 30 ensure their correct positioning with respect to the flanges 28. The tiles 30 extend around the whole of the radially inner periphery of the heat pipe 27 to define an annular radially inwardly facing surface 32 which is adjacent the rotary blade tips 25. The tiles 30 are metallic and bonded to the heat pipe flanges 28. The tiles 30 could, however, be formed from a suitable ceramic material as shown at 30' in FIG. 3A. It would of course, be necessary to mount ceramic tiles in such a manner that differences in the rites of thermal expansion of the heat pipe 27 and tiles 30 do not result in undersirably high stress loads being imposed upon the tiles 30.

The heat pipe 27 and tiles 30 together define an annular chamber 33 which serves to space apart a major portion of the heat pipe 27 away from the tiles 30.

The annular chamber 33 serves to provide a thermal barrier between a major portion of the heat pipe 27 and the tiles 30. Thus although the tiles 30 will heat up during turbine operation, the temperature of the heat pipe 27 will be generally lower than would be the case if more directly exposed to the hot gas stream passing through the turbine 13. It follows therefore that the heat pipe 27 and thus the shroud ring 26 will expand radially by a reduced amount, thereby maintaining the clearances between the tips 25 of the turbine blade 17 and the inner shroud surface 32 at comparatively low levels. Moreover since the majority of the shroud ring 26 is constituted by the heat pipe 27, it will tend to be isothermal during turbine operation, thereby avoiding undesirable distortion inducing thermal gradients.

If necessary, the operating temperature of the shroud ring 26 may be further reduced by providing an air flow through the annular chamber 33. This would of course necessitate the provision of a suitable inlet and outlet to the annular chamber 33.

Although the present invention has been described with reference to a shroud ring 26 comprising a heat pipe 27 with flanges 28, it may be appreciated that other configurations are possible without departing from the general concept of the present invention. Thus for instance, the flanges 28 on the heat pipe 27 could be omitted and the tiles 30 provides with substitute flanges which are not in the form of heat pipes. The annular chamber 33 would be retained, thereby providing the necessary spacing between the major portion of the heat pipe 27 and the surface defining portions of the tiles 30.

The present invention has been described with reference to an annular chamber 33 which contains air, either static or flowing, as on insulator. However, it may be convenient in certain circumstances to fill the chamber with a suitable solid insulating material.

I claim:

1. A shroud ring suitable for a turbine of a gas turbine engine, said shroud ring comprising:

an annular surface defining means having an annular radially inwardly facing surface;

an annular heat pipe positioned radially outwardly of said annular surface defining means; and spacing means positioned to radially space apart at least a major portion of said annular heat pipe from said annular surface defining means and defining an annular thermal barrier between said at least major portion of said heat pipe and said surface defining means.

2. A shroud ring as claimed in claim 1 wherein said annular thermal barrier is in the form of an annular chamber which is defined by said heat pipe, said surface defining means and said spacing means, and contains a thermal insulator.

3. A shroud ring as claimed in claim 2 wherein said thermal insulator is air.

4. A shroud ring as claimed in claim 1 wherein said spacing means comprises radially inwardly extending flanges which constitute portions of said annular heat pipe.

5. A shroud ring as claimed in claim 1 wherein said annular surface defining means comprises a plurality of abutting tiles which together define said radially inwardly facing surface.

6. A shroud ring as claimed in claim 5 wherein said tiles are metallic.

7. A shroud ring suitable for a turbine of a gas turbine engine, said shroud ring comprising:

an annular surface defining means having an annular radially inwardly facing surface;

an annular heat pipe positioned radially outwardly of said annular surface means having a generally U-shaped cross-section to provide two radially extending flanges which constitute portions of said annular heat pipe to radially space apart at least a major portion of said annular heat pipe from said annular surface means which bridges said flanges defining an annular chamber between at least a major portion of said annular heat pipe and said annular surface means;

said annular chamber having air as a thermal insulator contained therein providing a thermal barrier between said annular heat pipe and said annular surface means.

8. A shroud ring suitable for a turbine of a gas turbine engine, said shroud ring comprising:

a plurality of abutting tiles which together define an annular radially inwardly facing surface, wherein said tiles are selected from the group consisting of metallic or ceramic;

an annular heat pipe positioned radially outwardly of said annular radially inwardly facing surface having a generally U-shaped cross-section to provide two radially extending flanges which constitute portions of said annular heat pipe to radially space apart at least a major portion of said annular heat pipe from said annular radially inwardly facing surface which bridges said flanges defining an annular chamber between at least a major portion of said annular heat pipe and said annular radially inwardly facing surface;

said annular chamber having air as a thermal insulator contained therein providing a thermal barrier between said annular heat pipe and said annular radially inwardly facing surface.

* * * * *